US006823900B2

(12) United States Patent
Wildeman et al.

(10) Patent No.: US 6,823,900 B2
(45) Date of Patent: Nov. 30, 2004

(54) FABRIC HAVING A DECORATIVE TEXTURED SURFACE

(75) Inventors: Martin Wildeman, Spartanburg, SC (US); Jeffrey Carpenter, Columbus, NC (US); Glenda Carpenter, Columbus, NC (US)

(73) Assignee: Tietex International, Ltd., Spartanburg, SC (US)

( * ) Notice: Subject to any disclaimer, the term of this patent is extended or adjusted under 35 U.S.C. 154(b) by 44 days.

(21) Appl. No.: 09/932,274

(22) Filed: Aug. 17, 2001

(65) Prior Publication Data

US 2003/0033698 A1 Feb. 20, 2003

(51) Int. Cl.[7] ..... D03D 27/00

(52) U.S. Cl. ..... 139/391; 139/383 R; 139/420 R; 139/426 R

(58) Field of Search ..... 139/383 R, 391, 139/420 R, 426 R

(56) References Cited

U.S. PATENT DOCUMENTS

| | | | | |
|---|---|---|---|---|
| 4,000,342 A | | 12/1976 | Rochelle et al. | |
| 4,316,928 A | * | 2/1982 | Otto | 442/195 |
| 4,409,800 A | | 10/1983 | Gutschmit et al. | |
| 4,468,844 A | * | 9/1984 | Otto | 26/28 |
| 4,567,075 A | | 1/1986 | Krawczyk | |
| 4,712,281 A | | 12/1987 | Scheller | |
| 4,756,340 A | | 7/1988 | Janssen | |
| 5,084,322 A | | 1/1992 | Brioschi et al. | |
| 5,284,034 A | | 2/1994 | Weis et al. | |
| 5,358,198 A | | 10/1994 | Lesley | |
| 5,427,723 A | | 6/1995 | Kugler et al. | |
| 5,539,964 A | | 7/1996 | Russum et al. | |
| 5,557,950 A | | 9/1996 | Richards et al. | |
| 6,131,419 A | | 10/2000 | Rock et al. | |
| 6,177,170 B1 | | 1/2001 | Nash et al. | |
| 6,490,771 B1 | * | 12/2002 | Nash et al. | 28/163 |

FOREIGN PATENT DOCUMENTS

| | | | | |
|---|---|---|---|---|
| CA | 961250 | * | 1/1975 | 139/10 |

* cited by examiner

*Primary Examiner*—John J. Calvert
*Assistant Examiner*—Robert H. Muromoto, Jr.
(74) *Attorney, Agent, or Firm*—Dority & Manning, P.A.

(57) ABSTRACT

A fabric material having a textured surface and a process for producing the fabric material are disclosed. The fabric material is made from a woven fabric substrate including a warp yarn and at least first and second pick yarns. The first pick yarn is woven into the fabric substrate to provide integrity. The second pick yarn, on the other hand, is a yarn that is nappable from the surface of the fabric substrate. In accordance with the present invention, the fabric substrate is fed through a napping process which naps the second pick yarn appearing on the face of the fabric. The fabric substrate is then fed through a shearing process which shears the napped yarns. The napped and sheared yarns form pile-like tufts on the surface of the fabric. Ultimately, the napped and sheared yarns produce a velvet-like fabric having an improved aesthetic appearance.

16 Claims, 6 Drawing Sheets

FABRIC HAVING A DECORATIVE TEXTURED SURFACE

BACKGROUND OF THE INVENTION

Home furnishing fabrics and other decorative fabrics are designed to not only be durable but have aesthetic appeal. In some applications, the fabrics are highly engineered in order to provide the fabric with a unique look or design. In general, such fabrics can have two basic and well recognized types of designs or patterns. The first type is a design that is created with color, such as by using different colored yarns to weave the fabric.

The second type of fabric design is created by changing the texture of the fabric in a manner that creates a visual pattern. For instance, in one embodiment, the texture of the fabric can be changed by changing the weave. For example, a jacquard weaving system is a system of weaving that utilizes a highly versatile pattern mechanism to permit the production of large, intricate designs. Jacquard weaving systems are very complicated and provide the ability to control the action of each warp thread during the passage of a single pick. Jacquard systems are used to create tapestry, brocade, damask, and the like.

One particular textured fabric is a chenille fabric. Chenille fabrics are constructed from yarn made with a fuzzy pile protruding from all sides of the yarn. Chenille fabrics are made so that the yarns form tufts on the surface of the fabric providing a velvety pile. Consequently, the fabrics are not only decorative but have aesthetic appeal, softness, and bulk properties. Unfortunately, chenille fabrics and other similar fabrics are very expensive to produce. Due to their costs, chenille fabrics are used in limited applications. As such, a need currently exists for an inexpensive alternative to chenille fabrics and other highly decorative and textured fabrics.

SUMMARY OF THE INVENTION

The present invention is generally directed to a fabric material having a decorative textured surface and to a process for making the fabric material. The fabric material of the present invention is made from a woven fabric having a warp yarn, a first pick yarn, and a second pick yarn. The first pick yarn is generally woven into the back of the fabric for providing integrity and strength. The second pick yarn, on the other hand, is woven into the face of the fabric in a manner that allows it to be napped. For instance, the second pick yarn can be more loosely woven into the fabric than the first pick yarn. In accordance with the present invention, the second pick yarn is napped and is then subsequently sheared. In this manner, the napped yarns form texture on the surface of the fabric that provide the fabric with not only a pleasing hand but can also improve the aesthetic appeal.

The second pick yarns can be woven into the fabric so that they appear uniform across the face of the fabric or, alternatively, can be woven into the fabric so as to produce a decorative pattern on the surface of the fabric. By being napped and then sheared, the second pick yarn provides the fabric with a chenille-like look, by forming pile-like extensions off the fabric.

Fabrics processed according to the present invention can be woven using any suitable weaving device. In one particular embodiment, however, the fabric used in the present invention is a jacquard fabric formed on a jacquard weaving system.

For most applications, the second pick yarn that is used in the present invention is a spun yarn. The spun yarn can be made from either natural or synthetic fibers. For instance, in one embodiment, the second pick yarn can be a cotton spun yarn having a yarn count of about 6/2 to about 6/1.

The warp yarn and the first pick yarn, on the other hand, can be generally any suitable type of yarn such as a monofilament yarn, a multifilament yarn, or a spun yarn. The denier of the warp yarn can be from about 100 to about 2000 or an equivalent count thereof if using spun yarns. The first pick yarn, on the other hand, can have a count of from about 12/1 to about 6/1 or an equivalent count thereof. The warp yarn can be present in the fabric in an amount from about 88 to about 250 ends per inch, while the first pick yarn can be present in the fabric in an amount from about 34 picks per inch to about 38 picks per inch.

The process used to produce fabric materials in accordance with the present invention includes the steps of first providing or constructing a woven fabric substrate having a warp yarn, at least a first pick yarn and a second pick yarn, wherein the second pick yarn is nappable from the face side of the substrate. The fabric substrate is then fed through a napping process which naps the second pick yarn. Once the second pick yarn is napped, the fabric substrate is fed through a shearing process which shears the napped yarn. In particular, shearing removes long pile fibers present on the surface of the fabric and makes the length of the napped fibers uniform.

In one embodiment, prior to shearing the napped yarn on the face of the fabric, the napped yarn is oriented in a direction either vertical off the face of the fabric or at an angle facing away from the shearing device. In this manner, the napped yarns are more uniformly sheared or cut. The napped yarns can be oriented by being brushed, by being subjected to an air knife, or by being subjected to a vacuum device.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
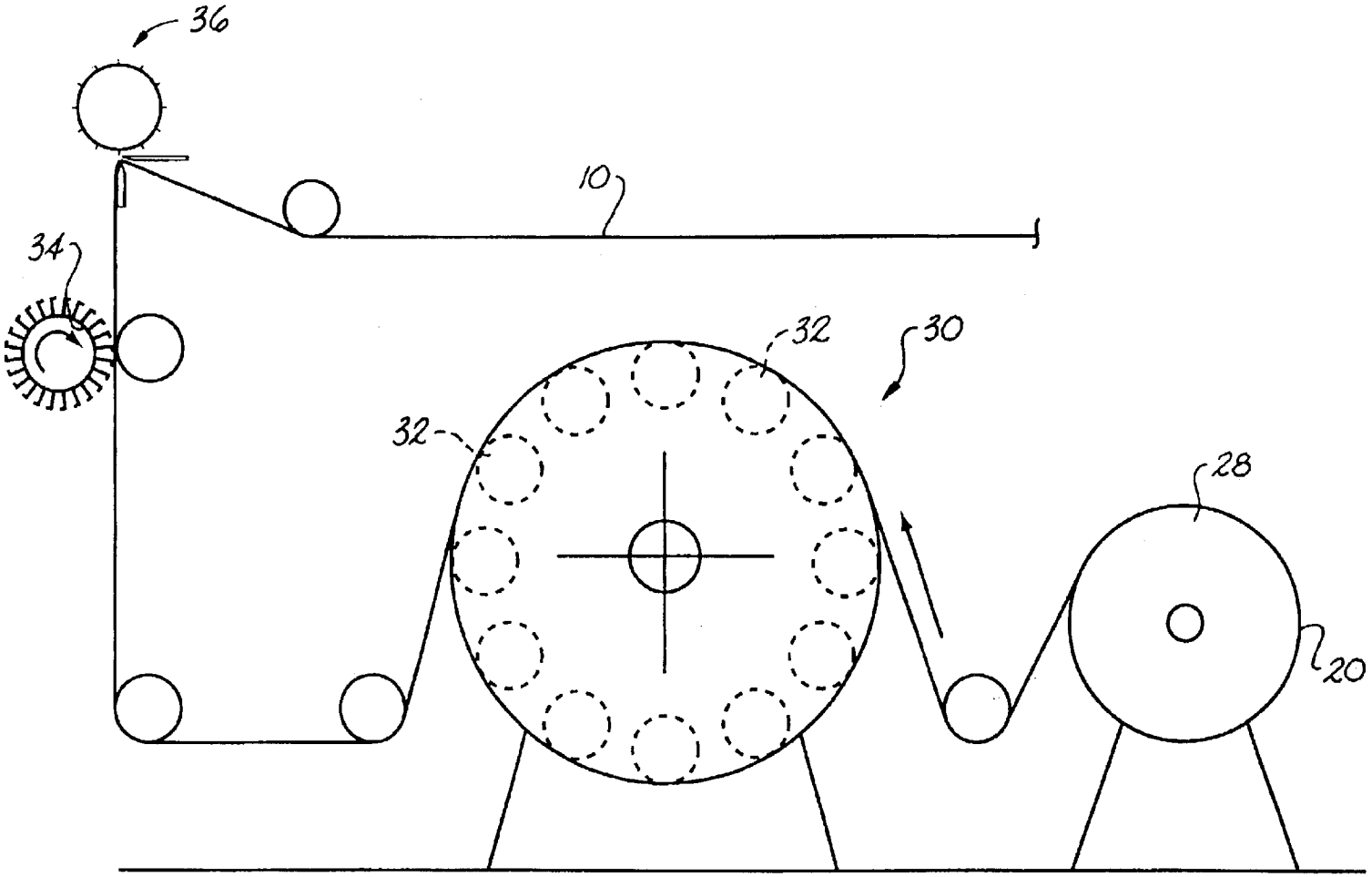
FIG. 1 is a side view of one embodiment of a process made in accordance with the present invention.

Repeated use of references characters in the present specification and drawings is intended to represent same or analogous features or elements of the invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

The present invention is generally directed to a decorative fabric having an aesthetic appearance. In particular, the fabric of the present invention includes a texturized surface produced through a napping and shearing process. The fabric has a chenille-like appearance, while being relatively inexpensive to produce.

Fabrics made according to the present invention have many useful and diverse applications. For instance, the fabric is well suited to be used in the home furnishings field such as an upholstery fabric or as a fabric used to make curtains and the like. It should be understood, however, that besides being used in the home furnishings field, fabrics made according to the present invention can also be used in many other and diverse applications.

In general, the fabric of the present invention is produced from a woven substrate. The woven fabric substrate includes warp yarns and at least a first pick yarn and a second pick yarn. The first pick yarn is woven into the fabric tightly in order to give the fabric integrity. The second pick yarn, on the other hand, is a yarn that is more loosely woven into the fabric or is otherwise available for napping. The second pick yarn can be woven into the fabric so as to appear on the face of the fabric according to a uniform density, can be woven into the face of the fabric to form a pattern, or can be woven into the face of the fabric in a random arrangement.

Any suitable weaving device for a weaving system can be used to form the woven fabric substrate. Of particular advantage, however, is that the woven fabric substrate can be formed on very fast weaving systems, such as an air jet loom to form an air jet woven substrate. In the past, it was very difficult if not impossible to produce chenille fabrics on such high speed weaving devices. Instead, chenille fabrics are produced on rapier machines. Of course, woven substrates made according to the present invention can also be produced on rapier machines.

Once the fabric substrate is constructed, the fabric substrate is fed through a napping process. During the napping process, only the second pick yarns are napped. Consequently, the fabric is only napped where the second pick yarns are located on the face of the fabric, which forms a unique pattern into the fabric. Subsequently, the fabric is fed through a shearing process during which the napped second pick yarn is sheared. By shearing the napped yarn, the second pick yarn has a tuft-like appearance on the face of the fabric.

Figure 3:
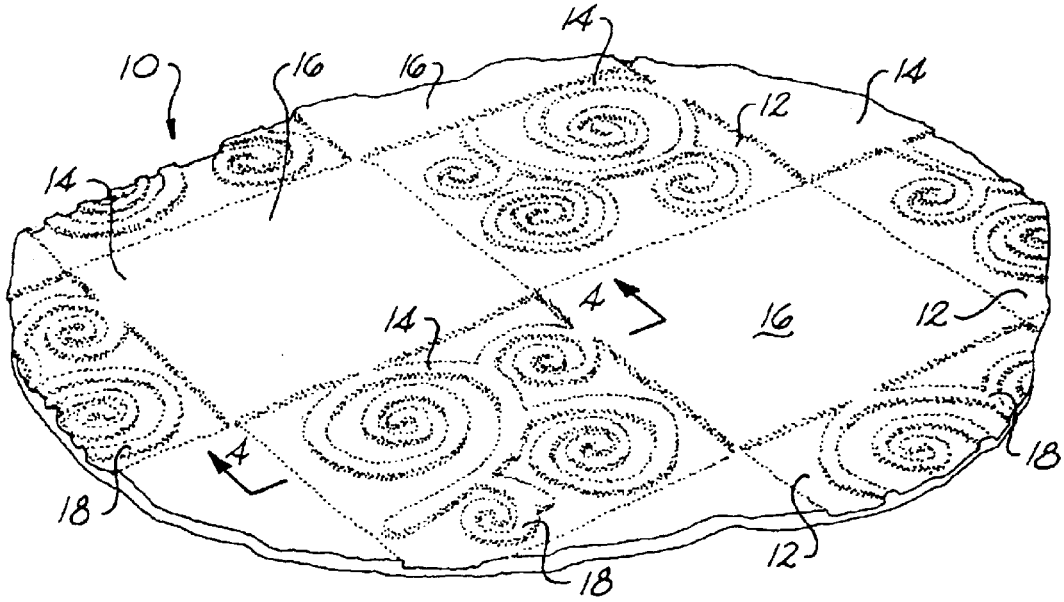
FIG. 3 is a perspective view of one embodiment of a fabric material made in accordance with the present invention.
Figure 4:
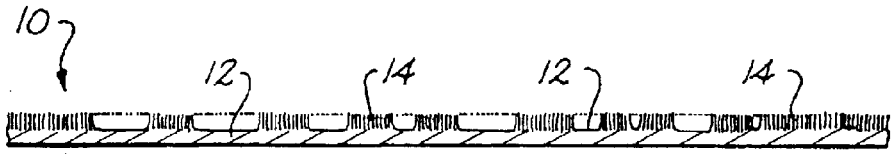
FIG. 4 is a side view of the fabric material shown in FIG. 3.

For example, referring to FIGS. 3 and 4, one embodiment of a fabric generally 10 made in accordance with the present invention is shown. As illustrated in FIG. 3, the fabric 10 includes recessed areas 12 surrounded by raised tuft-like or pile-like areas 14. The difference between recessed areas 12 and raised areas 14 are more clearly shown in FIG. 4.

Referring to FIG. 3, in this embodiment the napped pick yarns have been woven into the fabric 10 according to two different patterns 16 and 18. The first pattern 16 represent square sections or areas where the napped end sheared pick yarns are uniformly and evenly distributed. The second pattern 18, on the other hand, is made up of a repeating decorative design that is contained within a square recessed area 12.

Besides the pattern shown in FIG. 3, however, it should be understood that many other different types of patterns can be woven into the fabric as desired as will be made apparent from the following description of the process.

Figure 5:
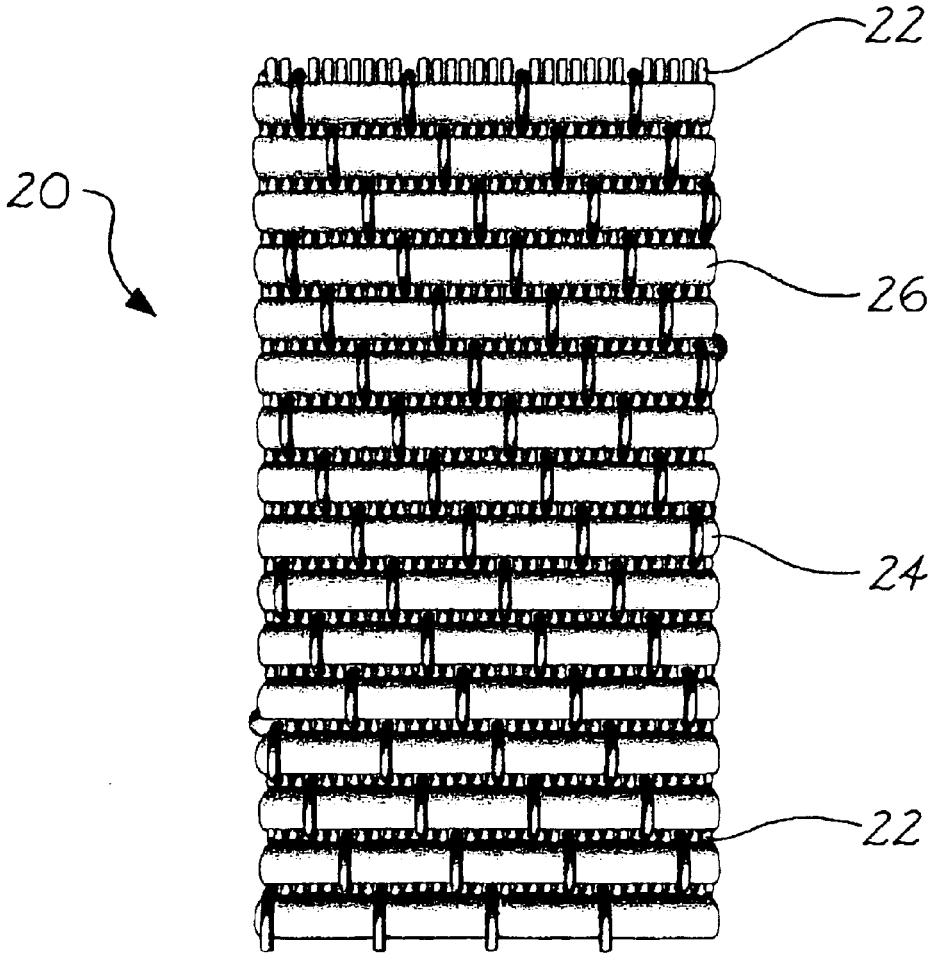
FIG. 5 is a plan view showing the front side of a fabric substrate that may be used in the process of the present invention.
Figure 6:
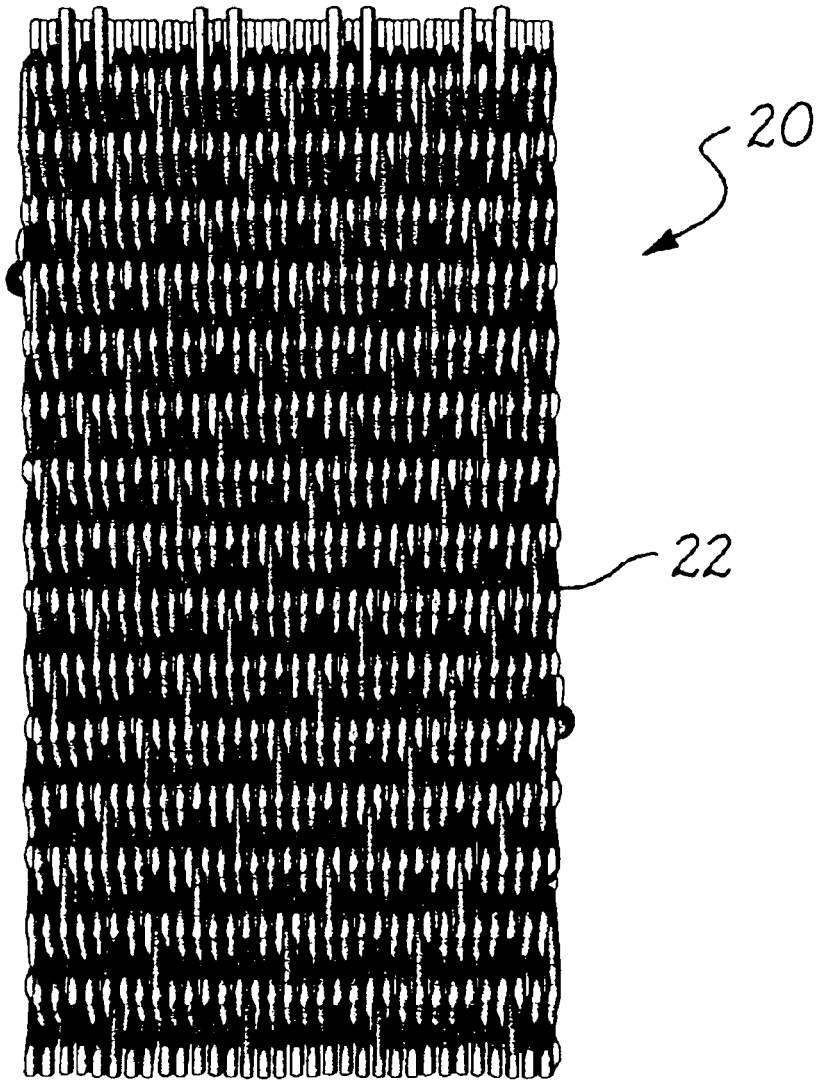
FIG. 6 is a plan view of the back side of the fabric shown in FIG. 5.
Figure 7:
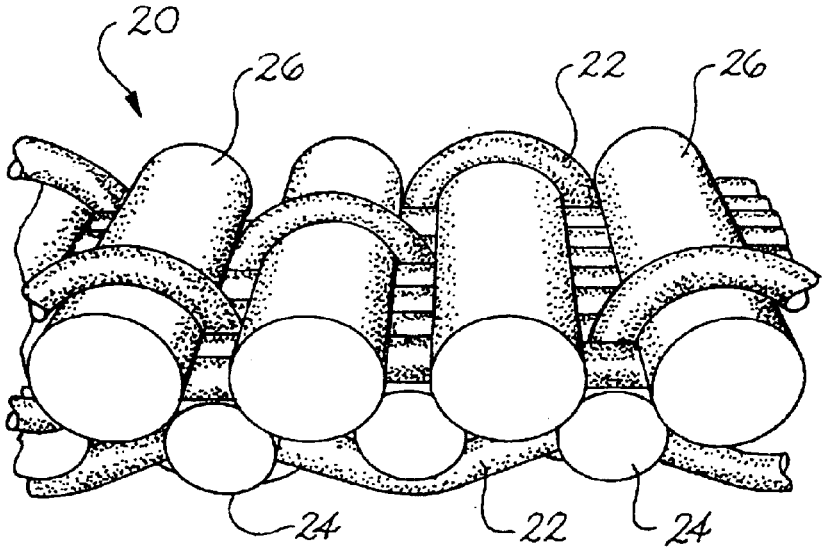
FIG. 7 is an exploded perspective view of the fabric illustrated in FIG. 5.

Referring now to FIGS. 5 through 7, for exemplary purposes, one embodiment of a fabric substrate generally 20 that can be processed according to the present invention is shown. In general, the fabric substrate 20 can be any woven fabric that includes at least a first pick yarn and a second pick yarn, wherein the second pick yarn is nappable without interfering with the first pick yarn. In this regard, any suitable woven fabric construction can be used in accordance with the present invention. In one embodiment, for instance, fabric substrate 20 can be a jacquard fabric.

Referring to the embodiment illustrated in FIGS. 5 through 7, the fabric substrate 20 is made from a set of warp yarns 22 that are interwoven with a set of first pick yarns 24 and a set of second pick yarns 26 as particularly shown in FIG. 7. The first pick yarns 24 are tightly woven into the back of the fabric substrate 20. A view of the back of the fabric is shown in FIG. 6.

The second pick yarns 26, on the other hand, are more loosely woven into the fabric. In this manner, the second pick yarns 26 are napped when the fabric substrate is fed through a napping process. A view showing the face of the fabric substrate 20 is shown in FIG. 5, which includes the nappable pick yarns 26.

In general, the second pick yarns 26 are spun yarns or continuous filament yarns, such as multifilament yarns. The yarns can be made from natural materials or from synthetic materials. For instance, the second pick yarns can be made from cotton fibers, rayon fibers, polyester fibers, polyethylene fibers, polypropylene fibers, nylon fibers, and the like.

In one particular embodiment of the present invention, the second pick yarns 26 are cotton spun yarns having a yarn count of from about 6/2 to about 6/1.

In general, any suitable weave can be used to insert the second pick yarns 26 into the fabric substrate 20, as long as the second pick yarns become nappable. In one particular embodiment, the second pick yarns 26 can be woven into the top of the fabric in a two layer weave arrangement. For instance, a plain weave can be used on picks 2 and 4, while a sixteen end filling weave can be used on picks 1 and 3.

The type of yarn that is used for first pick yarn 24 and the type of weave that is used in conjunction with the first pick yarn are generally not critical. For instance, the first pick yarn 24 can be a monofilament yarn, a multifilament yarn, or a spun yarn. In one embodiment, however, a cotton spun yarn can be used. The spun yarn can have a yarn count of from about 12/1 to about 6/1. When using monofilament or multifilament yarns, the denier of the yarns can be equivalent to the above.

As described above, the first pick yarns are woven into the back of the fabric substrate 20 using a relatively tight weave. The weave can be, for instance, a tabby weave, a taffeta weave or a plain weave. The first pick yarn can be woven into the fabric substrate in an amount or at a density of from about 34 picks per inch to about 38 picks per inch.

Similar to the first pick yarns 24, the warp yarns 22 can also be made from various materials. For instance, the warp yarns can be monofilament yarns, multifilament yarns, or spun yarns made from natural or synthetic materials. For example, in one embodiment, the warp yarns can be 150 denier multifilament polyester yarns. In general, however, the denier of the warp yarns can vary from about 100 to about 2000 or the equivalent thereof.

The amount of warp yarns present in the fabric substrate 20 or the density of the warp yarns can also vary depending upon the particular application. For most applications, the warp yarns can be present in the fabric substrate in an amount from about 88 ends per inch to about 250 ends per inch, and particularly from about 120 ends per inch to about 160 ends per inch.

Once a fabric substrate 20 as described above is constructed, the fabric substrate is then fed through a napping process and a shearing process. For instance, one embodiment of a napping and shearing process in accordance with the present invention is shown in FIG. 1. As shown, the fabric substrate 20 is unwound from a roll 28 and fed to a napping device generally 30 where the face side of the fabric substrate is napped.

Napping is a process that raises the surface fibers of the fabric by passing rapidly revolving cylinders covered with metal points or teasel burrs over the surface of the fabric. As used herein, napping is also intended to include brushing in which rotating brushes raise a nap on the fabric. As shown in FIG. 1, in this embodiment, the napping device 30 includes a plurality of napping rolls 32. The napping rolls 32 typically rotate in opposite directions while the fabric is fed over the napping device. One suitable napping device that may be used in the present invention is model 0999 marketed by the Gessner Corporation.

As described above, the fabric substrate 20 is contacted with the napping device such that only the second pick yarns are napped from the surface of the fabric. During napping, the second pick yarns are generally frayed but not substantially broken. In general, the fabric substrate should be napped in an amount sufficient to change the disposition of from about 55% to about 60% of the fibers in the second pick yarn that are present on the surface of the fabric substrate. Ultimately, a fuzzy nap is produced on the surface of the fabric substrate 20.

Figure 2:
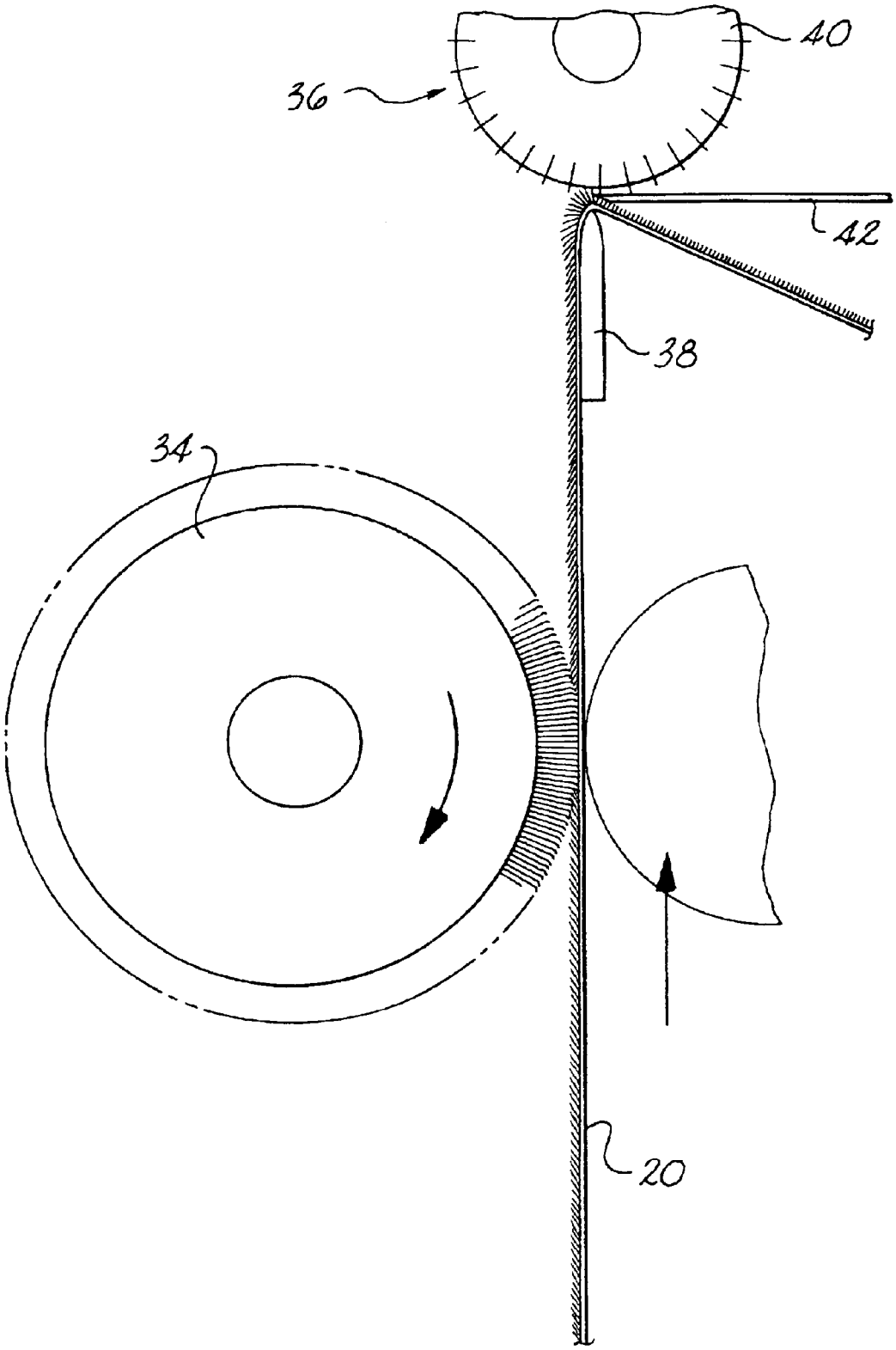
FIG. 2 is a side view of a rotary brush and shearing device used in accordance with the present invention.

Once the fabric substrate is napped, the fabric is then subjected to a shearing process which shears off a portion of the napped fibers to remove any excessively long fibers that may remain on the fabric. Shearing the napped yarn also improves the aesthetic appearance of the fabric. Prior to shearing, however, in one embodiment of the present invention, the napped fabric substrate is fed through a rotating wire brush 34 as particularly shown in FIG. 2. As shown in FIG. 2, the wire brush 34 is used to change the direction of the napped fibers prior to feeding the yarns to a shearing device 36. More particularly, the wire brush 34 is designed to orient the napped fibers so that they can be easily and uniformly sheared by the shearing device 36.

For instance, once the fabric substrate 20 is napped, the napped fibers tend to be oriented randomly on the face of the fabric or, as shown in FIG. 2, are angled in a direction towards the shearing device 26. Wire brush 34, however, orients the napped fibers such that the napped fibers are either perpendicular to the face of fabric or are angled away from the shearing device 36. Orienting the napped fibers in this manner facilitates shearing of the yarns.

For example, as shown in FIG. 2, after exiting the wire brush 34, the fabric substrate 20 is fed over a stationary cloth rest or roller 38 which presents the napped fibers for shearing. Specifically, the fabric substrate 20 is wrapped around the stationary cloth rest 38 in an amount of at least 90° which causes the napped fibers to extend vertically from the face of the fabric as the yarns are fed into the shearing device 36.

Shearing device 36 includes a shearing roll 40 and a ledger blade 42. The shearing roll 40 can include spiral blades that contact the ledger blade for cutting the napped fibers. One embodiment of a shearing device that may be used in the present invention is model D-41751 commercially sold by M-Tech of Germany.

The tolerance between the shearing roll 40 and the ledger blade 42 can be adjusted to optimize shearing of the napped fibers. For instance, the tolerance between the shearing roll 40 and the ledger blade 42 can be from about 0.02 inches to about 0.05 inches.

As shown in FIG. 2, the shearing device 36 shears off the napped fibers such that the napped fibers have a uniform height.

It should be understood that besides the wire brush 36, is believed that other devices can be used to orient the napped fibers and present them to the shearing device. For instance, instead of a wire brush, it is believed that an air knife or a vacuum tool could also be used.

Once exited the shearing device 36, a fabric 10 formed in accordance with the present invention is produced. The basis weight of fabrics made in accordance with the present invention can generally vary depending upon the particular application. For most applications, however, the basis weight of the fabric will be from about 4.0 osy to about 18 osy, and particularly from about 7.0 osy to about 12 osy.

Through the process of the present invention, many different types of decorative fabrics can be produced, such as the fabric illustrated in FIG. 3. The fabrics can not only be made having a color pattern, but are also produced with a decorative texturized pattern. The fabrics can be used in almost a limitless variety of applications as desired.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A fabric material comprising:

a woven fabric having a weave design repeat including a warp yarn and only two pick yarns comprising a first pick yarn and a second pick yarn, said second pick yarn being more loosely woven into said fabric in comparison to said first pick yarn, said second pick yarn being napped and subsequently sheared.

2. A fabric material as defined in claim 1, wherein said second pick yarn comprises a spun yarn.

3. A fabric as defined in claim 1, wherein said woven fabric comprises a jacquard fabric.

4. A fabric material as defined in claim 1, wherein said warp yarn is present in said woven fabric in an amount of from about 88 warp yarns per inch to about 250 warp yarns per inch, and said first pick yarn is present in said fabric in an amount from about 34 yarns per inch to about 38 yarns per inch.

5. A fabric material as defined in claim 1, wherein said second pick yarn comprises a spun cotton yarn having a yarn count of from about 6/2 t about 6/1.

6. A fabric material as defined in claim 1, wherein said second pick yarn comprises a continuous filament polyester yarn.

7. A fabric material as defined in claim 1, wherein said woven fabric comprises an air jet woven fabric.

8. A fabric material as defined in claim 2, wherein said second pick yarn contains synthetic fibers.

9. A fabric material as defined in claim 4, wherein said warp yarns have a denier of from about 100 to about 2,000.

10. A fabric material as defined in claim 1, wherein said second pick yarns form a visible pattern on said fabric.

11. A fabric material as defined in claim 1, wherein said woven fabric includes from about 3 to about 7 pick yarns per inch.

12. A fabric material as defined in claim 1, wherein said first pick yarn is woven into said fabric using a plain weave, a tabby weave, or a taffeta weave.

13. A fabric material as defined in claim 1, wherein said first pick yarn has a yarn count from about 12/1 to about 6/1 or equivalent count thereof.

14. A fabric material having a weave design repeat including a textured surface comprising:

a jacquard fabric having a warp yarn, a first pick yarn and a second pick yarn, said second pick yarn being more loosely woven into said fabric in comparison to said first pick yarn, said second pick yarn comprising a spun yarn, said second pick yarn being napped from the surface of said fabric and subsequently sheared, said second pick yarn being woven into said fabric so as to form a visible pattern on said fabric and wherein said warn yarn is present in said woven fabric in an amount of from about 88 warp yarns per inch to about 250 warn yarns per inch, and said first pick yarn is present in said fabric in an amount from about 34 yarns per inch to about 38 yarns per inch.

15. A fabric material as defined in claim 14, wherein said second pick yarn comprises a spun cotton yarn having a yarn count from about 6/2 to about 6/1.

16. A fabric material as defined in claim 14, wherein said first pick yarn is woven into said fabric using a plain weave, a tabby weave, or a taffeta weave.

* * * * *

UNITED STATES PATENT AND TRADEMARK OFFICE

CERTIFICATE OF CORRECTION

PATENT NO. : 6,823,900 B2 
DATED : November 30, 2004
INVENTOR(S) : Martin Wildeman, Jeffrey Carpenter and Glenda Carpenter It is certified that error appears in the above-identified patent and that said Letters Patent is hereby corrected as shown below:

Column 7,
Lines 10 and 11, A fabric material having a "weave design repeat including a" textured surface comprising:"

Signed and Sealed this

Fourteenth Day of June, 2005

JON W. DUDAS
*Director of the United States Patent and Trademark Office*